US008852061B2

(12) United States Patent
Verheem

(10) Patent No.: US 8,852,061 B2
(45) **Date of Patent: *Oct. 7, 2014**

(54) EXERCISE DEVICE WITH SUSPENDED INERTIAL CORE

(71) Applicant: Johann B. Verheem, Encinitas, CA (US)

(72) Inventor: Johann B. Verheem, Encinitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/903,641

(22) Filed: May 28, 2013

(65) Prior Publication Data

US 2013/0316881 A1 Nov. 28, 2013

Related U.S. Application Data

(63) Continuation of application No. 12/680,519, filed as application No. PCT/US2009/061833 on Oct. 23, 2009, now Pat. No. 8,469,865.

(51) Int. Cl.

| | |
|---|---|
| ***A63B 21/22*** | (2006.01) |
| ***A63B 41/00*** | (2006.01) |
| ***A63H 17/00*** | (2006.01) |
| ***A63B 21/02*** | (2006.01) |
| ***A63B 21/00*** | (2006.01) |
| ***A63B 21/06*** | (2006.01) |

(52) U.S. Cl.

CPC ..... *A63B 21/22* (2013.01); *A63B 21/027* (2013.01); *A63B 21/0004* (2013.01); *A63B 21/0602* (2013.01); *A63B 41/00* (2013.01)

USPC ..... 482/110; 446/220

(58) Field of Classification Search

USPC ..... 482/77, 93, 110, 123, 140, 148, 482/907–908; 446/220–221, 437; 473/594, 473/595, 604

See application file for complete search history.

(56) References Cited

U.S. PATENT DOCUMENTS

| | | | | | |
|---|---|---|---|---|---|
| 2,387,433 | A | * | 10/1945 | Fenton | 473/611 |
| 2,625,770 | A | * | 1/1953 | Steen et al. | 446/221 |
| 4,279,632 | A | * | 7/1981 | Frosch et al. | 65/21.4 |
| 4,842,563 | A | * | 6/1989 | Russell | 446/221 |
| 5,070,610 | A | * | 12/1991 | Leslie | 29/899.1 |
| 5,098,329 | A | * | 3/1992 | Tseng | 446/221 |
| 5,242,348 | A | * | 9/1993 | Bates | 482/105 |
| 5,286,020 | A | * | 2/1994 | Caruso | 473/603 |
| 5,433,136 | A | * | 7/1995 | Lung-Po | 92/58.1 |
| 6,190,292 | B1 | * | 2/2001 | Panes | 482/93 |
| 6,422,960 | B1 | * | 7/2002 | Touhey et al. | 473/593 |
| 6,537,125 | B1 | * | 3/2003 | Motosko, III | 446/220 |
| 6,572,499 | B2 | * | 6/2003 | Davies | 473/604 |

(Continued)

*Primary Examiner* — Stephen Crow

(74) *Attorney, Agent, or Firm* — Gordon Rees Scully Mansukhani LLP

(57) ABSTRACT

An inertial exercise device includes a hollow outer ball and a weighted inner ball elastically suspended inside the outer ball by at least two opposing suspension members. The weighted inner ball may contain a fluid mass. The hollow outer ball, the weighted inner ball and the at least two opposing suspension members may all be integrally formed with each other. In one embodiment, the outer ball, the inner ball, and the suspension members are all formed from integral segments of a pliant tube. The hollow outer ball is formed by everting first and second end segments of the tube over the middle segment of the tube and joining the first and second end segments of the tube together at their openings. The weighted inner ball is formed from the middle segment of the tube which, in one embodiment, is a bulge in the tube.

21 Claims, 13 Drawing Sheets

(56) References Cited

U.S. PATENT DOCUMENTS 6,652,421 B1 * 11/2003 Chen ..... 482/49
8,002,652 B2 * 8/2011 Wong ..... 473/594
2005/0043155 A1 * 2/2005 Yannitte ..... 482/131
2007/0066461 A1 * 3/2007 Carter et al. ..... 482/140

* cited by examiner

EXERCISE DEVICE WITH SUSPENDED INERTIAL CORE

CROSS-REFERENCE TO RELATED APPLICATIONS

The present application is a continuation of U.S. Ser. No. 12/680,519 filed Mar. 26, 2010 now U.S. Pat. No. 8,469,865 issued Jun. 25, 2013, which is a national stage entry of International Application serial no. PCT/US2009/061833 filed Oct. 23, 2009. The contents of each prior application are incorporated herein by reference in their entirety as if set forth verbatim.

FIELD

The following description relates generally to exercise equipment, and more particularly to an inertial exercise device with an elastically suspended inner core.

BACKGROUND

In-home personal exercise and weight loss equipment are increasingly popular consumer products. Due to the expense of health club memberships and the time required to travel to health clubs, many people desire to exercise at home. However, many exercise machines are very expensive and require a dedicated area or room for use and/or storage. For these reasons many people do not wish to own a large exercise machine that can exercise several different muscles.

Alternatives to large home fitness machines include fitness balls such as medicine balls and inflatable exercise balls. Medicine balls are typically leather, vinyl or fabric bladders filled with a dense material such as sand, and surrounded by impact absorbing materials. A typical medicine ball is approximately 12-16 inches in diameter and generally weighs anywhere from 5 to 30 pounds. Medicine balls are frequently used as part of weight training, injury rehabilitation, and plyometric exercises, and are particularly well-suited for strengthening core muscles such as abdominals.

Another type of fitness ball is an inflatable exercise ball, which is typically used for stretching and core-strengthening exercises. Inflatable exercise balls are typically much larger and lighter than medicine balls. For example, a typical inflatable exercise ball may be about 16 to 36 inches in diameter and weigh only 2 to 5 pounds. Inflatable exercise balls are generally made from an elastic polymer such as polyvinyl chloride and filled with air until taut. Thus, inflatable exercise balls can be bounced on the ground.

However, both medicine balls and inflatable exercise balls have significant drawbacks. One drawback of medicine balls is that many people are intimidated to use them due to their size and weight, which are typically not adjustable. Further, many women may not be inclined to use medicine balls due to a perception that they are primarily used for men's exercises. Another drawback of medicine balls is that many of the exercises become monotonous and repetitive so that the user eventually loses interest in continuing to perform the same exercise. Finally, another problem with medicine balls is that the internal weight is directly connected to the outer bladder so that when a user catches a thrown medicine ball, the impact on the user's body is severe and immediate.

Similarly, inflatable exercise balls are not adjustable in weight and are therefore limited in being useful for strenuousness exercises. Further, inflatable exercise balls also may suffer from a gender bias, namely that many men are not inclined to use inflatable exercise balls due to a perception that they are primarily used for women's exercises.

Accordingly, there is a need for an exercise device that combines the benefits of both medicine balls and inflatable exercise balls in a single device, and that includes new features that eliminate the foregoing drawbacks of medicine balls and inflatable exercise balls. Such an improved exercise device would ideally be adjustable in weight and capable of being used in a wide variety of new and interesting exercises. Finally, such an improved exercise device would ideally be low-impact in nature. The embodiments of an inertial exercise device disclosed below satisfy these needs.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments an inertial exercise device includes a hollow outer ball and a weighted inner ball elastically suspended inside the outer ball by at least two opposing suspension members. The weighted inner ball may contain a fluid mass. The weighted inner ball and the at least two opposing suspension members may be integrally formed with each other as a single continuous piece. The weighted inner ball may contain water, and the hollow outer ball may be inflated with a fluid such as air.

The inertial exercise device may be formed from a pliant tube. The pliant tube includes a middle segment with a maximum diameter equal to a first diameter, and first and second end segments on opposite sides of the middle segment, each end segment terminating in an opening with a second diameter greater than the first diameter. The hollow outer ball of the inertial exercise device is formed by everting the first and second end segments of the tube over the middle segment of the tube and joining the first and second end segments of the tube together at their openings. The weighted inner ball of the inertial exercise device is formed from the middle segment of the tube. The pliant tube may further include a first neck disposed between the first end segment of the tube and the middle segment of the tube, the first neck having a first minimum inner diameter less than the first diameter, and a second neck disposed between the second end segment of the tube and the middle segment of the tube, the second neck having a second minimum inner diameter less than the first diameter. The first and second minimum inner diameters may be equal, and in some embodiments one or both may be equal to zero, for example where the tube is solid for some of its length instead of hollow.

The inertial exercise device may also include a first watertight plug disposed in the first neck and a second watertight plug disposed in the second neck. Either or both of the first and second watertight plugs may be removable, and may include a valve with a first position allowing fluid communication into the weighted inner ball from outside the weighted inner ball and a second position prohibiting fluid communication into the weighted inner ball from outside the weighted inner ball. Thus, the weighted inner ball may contain a fluid such as water.

In embodiments of an inertial exercise device formed from a tube, the tube may have a variable wall thickness so that the suspension member elastically suspending the weighted inner ball has a variable elasticity dependent upon the wall thickness of the tube adjacent to the first and second necks of the tube. Further, the tube may have a cross-section of any shape, including round.

In another aspect of the disclosed embodiments, an inertial exercise device is formed from a pliant tube having a middle segment, first and second end segments on opposite sides of the middle segment, a first neck segment between the first end segment and the middle segment, and a second neck segment between the second end segment and the middle segment. The middle segment has a maximum diameter equal to a first diameter, and the first and second end segments each terminate in an opening with a second diameter greater than the first diameter. The first neck segment has a first minimum diameter less than the first diameter, and the tube tapers from the first diameter of the middle segment to the first minimum diameter of the first neck segment and from the opening of the first end segment to the first minimum diameter of the first neck segment. The second neck segment has a second minimum diameter less than the first diameter, and the tube tapers from the first diameter of the middle segment to the second minimum diameter of the second neck segment and from the opening of the second end segment to the second minimum diameter of the second neck segment. A hollow outer chamber is formed by everting the first and second end segments of the tube over the middle segment of the tube and joining the first and second end segments of the tube together at their openings. A weighted inner chamber is formed from the middle segment of the tube, and is elastically suspended inside the hollow outer chamber by the first and second neck segments of the tube.

The first minimum diameter of the first neck segment may be equal to the second minimum diameter of the second neck segment, and either or both diameters may be an inner diameter equal to zero. A first watertight plug may be disposed in the first neck and a second watertight plug may be disposed in the second neck segment. Either or both of the first watertight plug and the second watertight plug may be removable. Either or both of the first watertight plug and the second watertight plug may incorporate a valve with a first position allowing fluid communication into the weighted inner chamber from outside the weighted inner chamber and a second position prohibiting fluid communication into the weighted inner chamber from outside the weighted inner chamber. The weighted inner chamber may contain a fluid such as water.

The tube forming the inertial exercise device may have a variable wall thickness so that the neck segments elastically suspending the weighted middle segment have a variable elasticity dependent upon the wall thickness of the tube in the neck segments. Further, the tube may have a cross-section of any shape, including round. The first end segment, the second end segment, the first neck segment, the second neck segment and the middle segment may all be integral parts of a single pliant tube. Alternatively, the first end segment, the second end segment, and the middle segment may each be individually separate components that are joined together to form the pliant tube.

In another aspect of the disclosed embodiments, a method of manufacturing an inertial exercise device is provided. The method includes providing a pliant tube with first and second open ends and forming a bulge in a middle segment of the tube. The bulge of the middle segment of the tube has a maximum diameter equal to a first diameter. An outwardly expanding first end segment is formed between the bulge in the middle segment of the tube and the first open end of the tube. The first end segment increases in diameter from the bulge to a first opening at the first open end of the tube. The first opening has a diameter equal to a second diameter greater than the first diameter. An outwardly expanding second end segment is formed between the bulge and the second open end of the tube. The second end segment increases in diameter from the bulge to a second opening at the second open end of the tube. The second opening has a diameter equal to the second diameter. The first and second end segments of the tube are everted over the bulge in the middle segment of the tube and the first and second end segments of the tube are joined together at the first and second openings to form a hollow outer chamber. A weighted inner chamber is formed from the bulge in the middle segment of the tube, and is elastically suspended inside the hollow outer chamber.

A method of manufacturing an inertial exercise device may further include forming a first neck in the tube between the bulge and the first end segment. The first neck has a minimum inner diameter equal to a third diameter which is less than the first diameter. A second neck in the tube is formed between the bulge and the second end segment. The second neck has a minimum diameter equal to a fourth diameter which is also less than the first diameter, and may be equal to the third diameter. The method may further include at least partially filling the weighted inner chamber with a fluid such as water, and making the weighted inner chamber watertight by plugging the first and second necks with first and second watertight plugs respectively. The method may further include providing the first watertight plug with a valve with a first position allowing fluid communication into the weighted inner chamber from outside the weighted inner chamber and a second position prohibiting fluid communication into the weighted inner chamber from outside the weighted inner chamber.

In another aspect of the disclosed embodiments, an exercise kit is provided. The exercise kit includes an inertial exercise device with an inflatable outer chamber having an inner wall, a fluid fillable inner chamber elastically attached to the inner wall of the inflatable outer chamber, and a fill valve in fluid communication with the fluid fillable inner chamber. The exercise kit also includes a pump comprising a pump chamber in fluid communication with a pump hose. The pump hose terminates in a fitting engageable with the fill valve of the inertial exercise device. The inertial exercise device is adapted to fit inside the pump chamber when the inflatable outer chamber of the inertial exercise device is deflated and the fluid fillable inner chamber of the inertial exercise device is empty of fluid.

The inertial exercise device may include an air fill valve in fluid communication with the inflatable outer chamber. If so, the fitting of the pump hose may be engageable with the air fill valve of the inertial exercise device.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
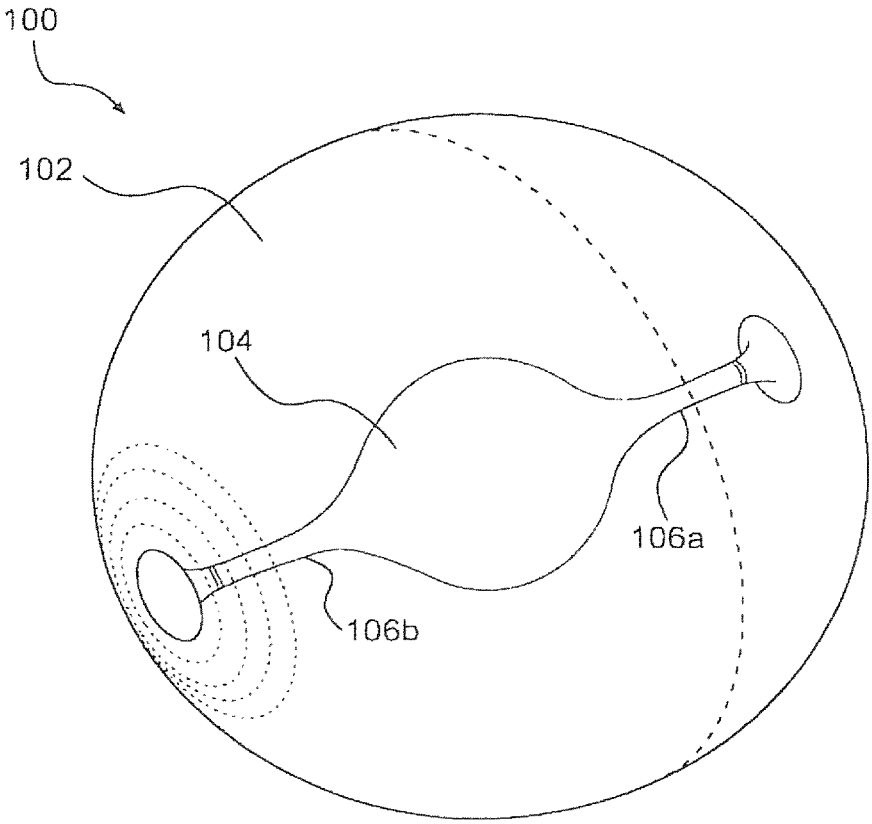
FIG. 1 is a perspective view of one embodiment of an inertial exercise device, showing the inertial exercise device in a rest position.

In one aspect of the disclosed embodiments, an inertial exercise device includes a hollow outer ball and a weighted inner ball elastically suspended inside the outer ball by at least two opposing suspension members. The weighted inner ball may contain a fluid mass. The hollow outer ball, the weighted inner ball and the at least two opposing suspension members may all be integrally formed with each other, or may be formed separately and thereafter to connected to one another. The weighted inner ball may contain water and the hollow outer ball may be inflated with a fluid such as a gas or liquid. In one embodiment, the outer ball, the inner ball, and the suspension member are all formed from integral segments of a pliant tube with a middle segment and first and second end segments on opposite sides of the middle segment. Each end segment terminates in an opening with a greater diameter than the middle segment. The hollow outer ball is formed by everting the first and second end segments of the tube over the middle segment of the tube and joining the first and second end segments of the tube together at their openings. The weighted inner ball is formed from the middle segment of the tube which, in one embodiment, is a bulge in the tube.

In another aspect of the disclosed embodiments, an inertial exercise device is formed by everting a pliant tube. The pliant tube has a middle segment with a maximum diameter equal to a first diameter, a first end segment and a second end segment. The first and second end segments are on opposite sides of the middle segment, and the first and second end segments each terminate in an opening with a second diameter greater than the first diameter. A first neck segment is disposed between the first end segment of the tube and the middle segment of the tube. The first neck segment has a first minimum diameter less than the first diameter, and the tube tapers from the first diameter of the middle segment to the first minimum diameter of the first neck segment and from the opening of the first end segment to the first minimum diameter of the first neck segment. A second neck is segment disposed between the second end segment of the tube and the middle segment of the tube. The second neck segment has a second minimum diameter less than the first diameter, and the tube tapers from the first diameter of the middle segment to the second minimum diameter of the second neck segment and from the opening of the second end segment to the second minimum diameter of the second neck segment. A hollow outer chamber is formed by everting the first and second end segments of the tube over the middle segment of the tube and joining the first and second end segments of the tube together at their openings. A weighted inner chamber is formed from the middle segment of the tube, and the weighted inner chamber is elastically suspended inside the hollow outer chamber by the first and second neck segments of the tube.

In another aspect of the disclosed embodiments, a method of manufacturing an inertial exercise device begins by providing a pliant tube with first and second open ends and forming a bulge in a middle segment of the tube, the bulge having a maximum diameter equal to a first diameter. An outwardly expanding first end segment is formed, extending between the bulge and the first open end of the tube. The first end segment increases in diameter from the bulge to a first opening at the first open end of the tube, the first opening having a diameter equal to a second diameter greater than the first diameter. An outwardly expanding second end segment is formed, extending between the bulge and the second open end of the tube. The second end segment increases in diameter from the bulge to a second opening at the second open end of the tube, the second opening having a diameter equal to the second diameter. The first and second end segments of the tube are everted over the bulge in the middle segment of the tube and the first and second end segments of the tube are joined together at the first and second openings to form a hollow outer chamber. A weighted inner chamber is formed from the bulge in the middle segment of the tube, and the weighted inner chamber is elastically suspended inside the hollow outer chamber.

As seen in FIG. 1, in one embodiment an inertial exercise device 100 includes hollow outer ball 102 and weighted inner ball 104. As used herein, the term "hollow" means that outer ball 102 defines a cavity inside of which weighted inner ball 104 is contained. Weighted inner ball 104 is elastically suspended inside hollow outer ball 102 by suspension members 106 (referred to individually as first suspension member 106*a* and second suspension member 106*b*, and collectively as suspension members 106). Weighted inner ball 104 is optionally at least partially filled with a heavy substance such as a fluid mass in order to increase its inertia. For example, weighted inner ball 104 may be filled with a fluid mass such as water, gel, oil, or particulate matter. It is to be understood that the term "fluid" or "fluid mass" is defined broadly to include liquids, gels and particulate matter such as sand or plastic or metal pellets, or any combination of liquids, gels, oils, and/or particulate matter. Alternatively, instead of being at least partially filled with a fluid mass, weighted inner ball 104 may itself have sufficient mass to provide the inertia necessary for the exercise described below. For example, weighted inner ball 104 may be a solid elastomeric member.

Figure 2:
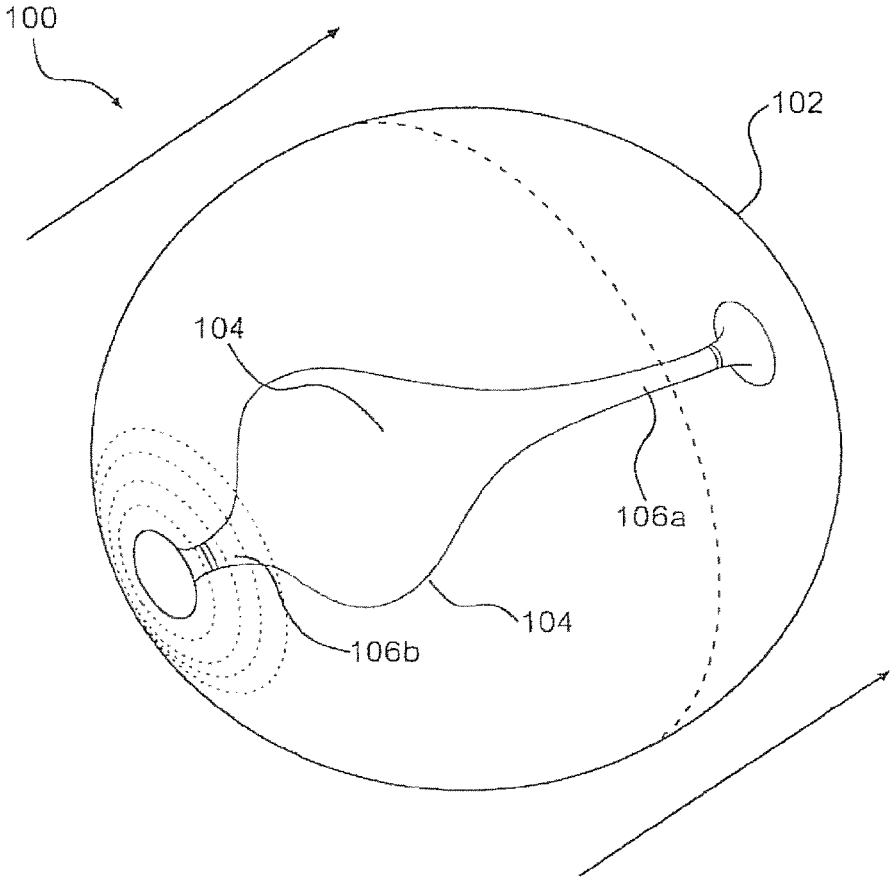
FIG. 2 is a perspective view showing the inertial exercise device of FIG. 1 after being moved in a first direction from the rest position.

A notable feature of inertial exercise device 100 is that hollow outer ball 102 and weighted inner ball 104 are not rigidly connected, but rather are elastically connected, so that they move somewhat independently of one another. More specifically, as shown in FIG. 2, when a user quickly moves inertial exercise device 100 in a first direction (indicated by the arrows in FIG. 2), the inertia of weighted inner ball 104 causes it to lag behind the movement of hollow outer ball 102 because, per Newton's first law, an object at rest tends to remain at rest until acted upon by an external force. As used herein, the term "inertia" means the tendency of a body to remain at rest or in uniform motion until acted upon by an external force. Further, this can be quantified according to Newton's second law which states that a body with mass m will accelerate at rate a if acted upon by external force F, or a=F/m.

In FIG. 1, inertial exercise device 100 is shown at rest with weighted inner ball 104 suspended approximately concentrically inside hollow outer ball 102. In this embodiment, both suspension members 106 are in tension (i.e. extended beyond their natural length) when inertial exercise device 100 is at rest, but the spring constants of both suspension members 106 are approximately the same so that at equilibrium they hold weighted inner ball 104 approximately concentric with hollow outer ball 102. As used herein, the term "spring constant" refers to the amount of force required to extend an elastic member a fixed distance. It should be noted that in reality the center of weighted inner ball 104 would be slightly below the center of hollow outer ball 102 due to the force of gravity, but for simplicity this small deflection is not shown in the drawings. Thus, until an external force acts upon weighted inner ball 104, suspension members 106 will hold weighted inner ball 104 approximately concentric with hollow outer ball 102.

Here, as shown in FIG. 2, the external force imparted to the system is the user's rapid acceleration of inertial exercise device 100 in the first direction (indicated by the arrows). Hollow outer ball 102 responds instantly to this force and immediately accelerates in the first direction. However, because weighted inner ball 104 is not rigidly connected to hollow outer ball 102, but is instead elastically connected thereto, weighted inner ball 104 tends to remain at rest and therefore begins to displace relative to hollow outer ball 102. In other words, because first suspension member 106*a* and second suspension member 106*b* are elastic and change in length in response to a change in the force imparted upon them, the inertia of weighted inner ball 104 causes first suspension member 106*a* to extend and second suspension member 106*b* to contract as weighted inner ball 104 displaces relative to hollow outer ball 102 as hollow outer ball 102 moves in the first direction.

The extension of first suspension member 106*a* increases the tensile force in first suspension member 106*a* pulling weighted inner ball 104 in the first direction of motion of hollow outer ball 102. Likewise, the contraction of second suspension member 106*b* decreases the tensile force in second suspension member 106*b* opposing motion of weighted inner ball 104 in the direction of hollow outer ball 102. Thus, the net result is that as weighted inner ball 104 increasingly displaces relative to hollow outer ball 102, the net force imparted on weighted inner ball 104 by suspension members 106 is increasingly in the direction of motion of hollow outer ball 102.

Eventually the net force imparted by suspension members 106 on weighted inner ball 104 is sufficient to accelerate weighted inner ball 104 in the first direction of motion to a velocity greater than that of hollow outer ball 102. This results in weighted inner ball 104 returning to, and possibly overshooting, its rest position at the center of hollow outer ball 102. More particularly, once the user has reached the edge of his range of motion in the first direction, the user will quickly reverse the direction of movement of inertial exercise device 100 into a second direction. Although the user will be able to almost instantly reverse direction of hollow outer ball 102, weighted inner ball 104 will initially remain in motion in the first direction due to its inertia and its elastic and non-rigid connection to hollow outer ball 102. Thus, at the moment the user reverses directions of inertial exercise device 100, hollow outer ball 102 and weighted inner ball 104 are simultaneously moving in opposite directions.

Figure 3:
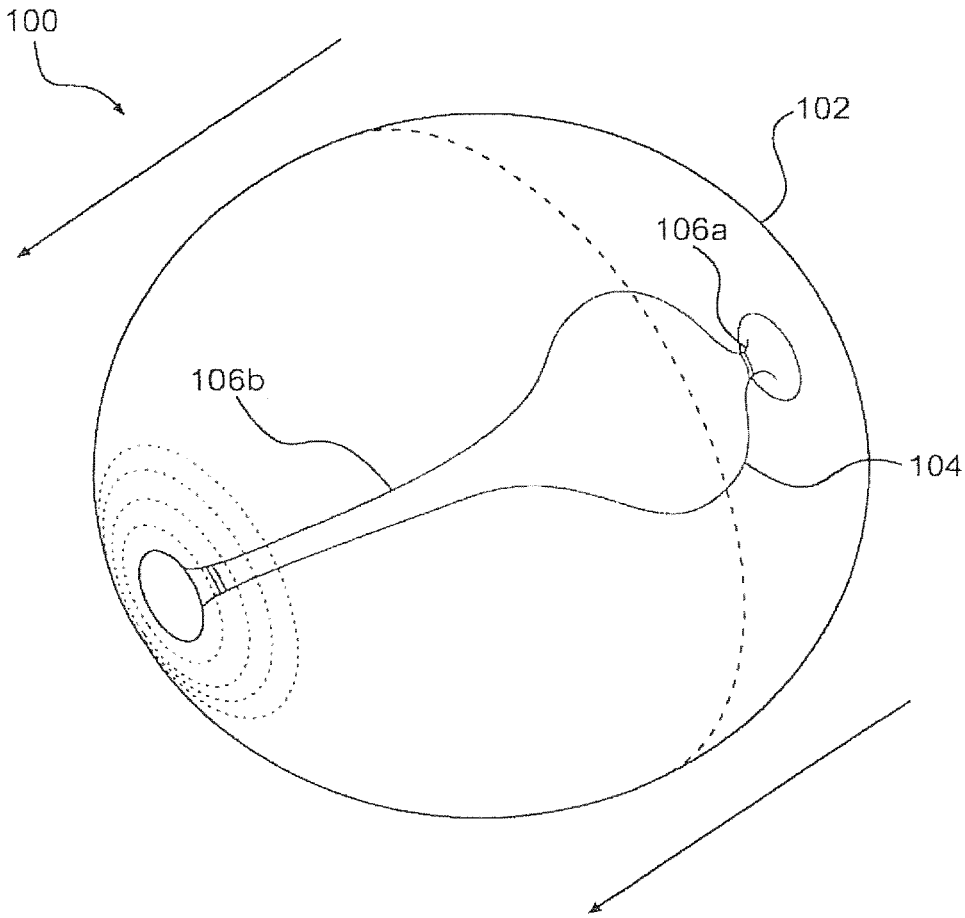
FIG. 3 is a perspective view showing the inertial exercise device of FIG. 1 after being moved in a second direction after moving in the first direction.

As shown in FIG. 3, as hollow outer ball 102 moves in the second direction (indicated by the arrows in FIG. 3) and weighted inner ball 104 moves in the first direction past the center of hollow outer ball 102, first suspension member 106*a* is compressed while second suspension member 106*b* is extended. In other words, the process described above with reference to FIG. 2 now reverses itself. As hollow outer ball 102 continues in the second direction and second suspension member 106*b* increasingly extends, the net force imparted on weighted inner ball 104 by suspension members 106 rapidly increases until it is sufficient to accelerate weighted inner ball 104 in the second direction so that it briefly moves in tandem with hollow outer ball 102. Finally, the user again reverses the direction of movement of inertial exercise device 100 into the first direction. The process described with reference to FIG. 2 repeats itself, except now weighted inner ball 104 is moving in the second direction (rather than being at rest) when the user first moves hollow outer ball in the first direction.

This process repeats itself each time the user reverses the direction of movement of inertial exercise device. An advantage of this type of dynamic inertial exercise is that the user is not just working against the mass of weighted inner ball 104 alone. Rather, the user must continually reverse the direction of motion of weighted inner ball 104. Thus the user must overcome the inertia of weighted inner ball 104 and its tendency to remain in uniform motion in one direction. This is more difficult than simply swinging a weight from side to side, because each time the user reverses direction, weighted inner ball 104 and hollow outer ball 102 are moving rapidly in opposite directions.

It can be seen that total range of motion of weighted inner ball 104 relative to hollow outer ball 102 in part depends on the relative sizes of each ball. If weighted inner ball 104 is relatively large (though still smaller than hollow outer ball 102) then there is less room for it travel back and forth inside hollow outer ball 102. If weighted inner ball 104 is relatively small, then it has a greater range of motion inside hollow outer ball 102. Although the ratio of the diameter of hollow outer ball 102 to the diameter of weighted inner ball 104 is not critical, in one embodiment the ratio is about 4 to 1. However, this ratio may vary greatly in other embodiments, for example, and without limitation, between 1.5 to 1 and 10 to 1.

Figure 4:
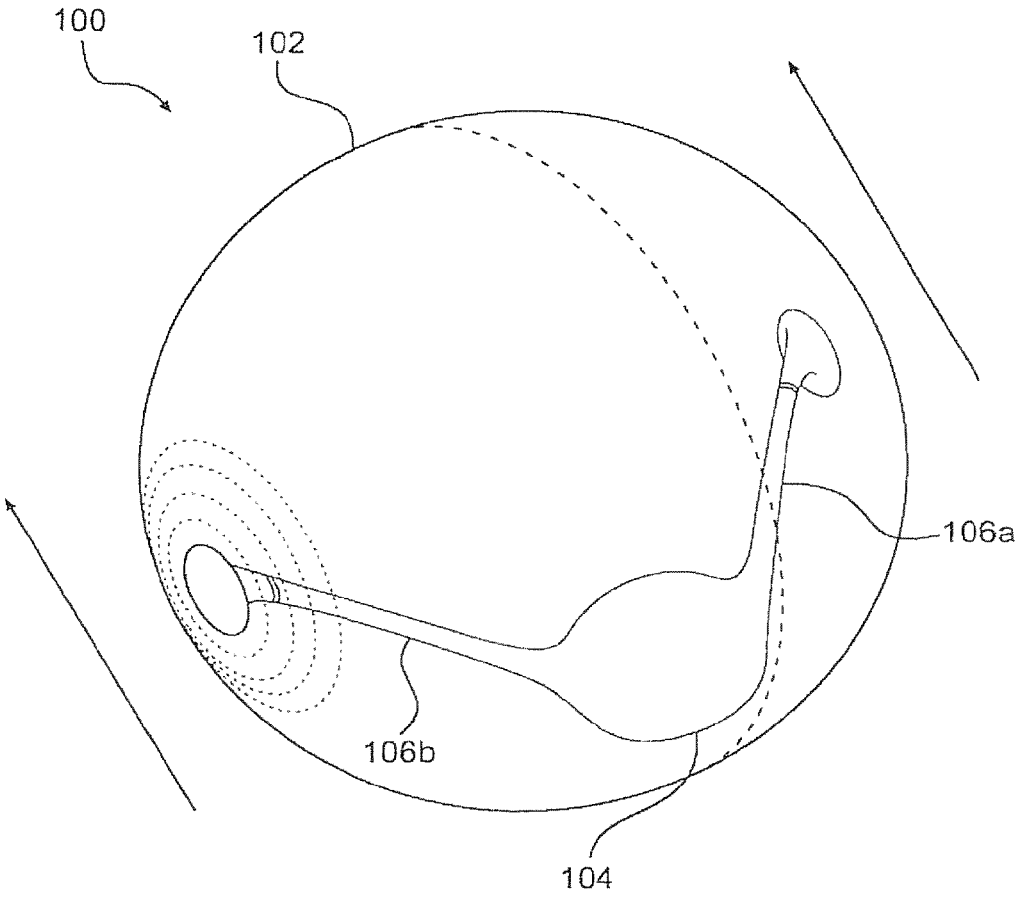
FIG. 4 is a perspective view showing the inertial exercise device of FIG. 1 after being moved in a third direction from the rest position.

Although FIGS. 2 and 3 show inertial exercise device 100 moving along the axis of suspension members 106, it is to be understood that inertial exercise device 100 can be moved in any direction and still provide the benefits of dynamic inertial exercise. For example, as shown in FIG. 4, inertial exercise device 100 can be moved along an axis perpendicular to suspension members 106. In this case, the rest state of inertial exercise device 100 is again as shown in FIG. 1. Here, however, the user quickly moves inertial exercise device 100 perpendicularly to the axis of suspension members 106. Hollow outer ball 102 responds instantly to the force imparted by the user and immediately moves in a first direction of motion perpendicular to the axis of suspension members 106. Due to its inertia and tendency to remain at rest, weighted inner ball 104 initially lags behind the movement of hollow outer ball 102.

In FIG. 4, however, it can be seen that both suspension members 106 are simultaneously extended due to the displacement of weighted inner ball 104 from hollow outer ball 102, unlike in FIGS. 2 and 3 where one suspension member 106 was compressed while the other extended. Once the combined extension of suspension members 106 becomes sufficiently large, the force they exert on weighted inner ball 104 causes weighted inner ball 104 to quickly accelerate in the first direction of motion such that it returns to or overshoots the center of hollow outer ball 102. Just as this occurs, the user reverses direction and moves inertial exercise device 100 in a second direction opposite to the first direction. Again, hollow outer ball 102 instantly responds to the change of direction, but the inertia of weighted inner ball 104 causes it to initially continue traveling in the first direction even though hollow outer ball 102 is traveling in the second direction. Weighted inner ball 104 continues in the first direction until the displacement between the centers of weighted inner ball 104 and hollow outer ball 102 is sufficiently large that suspension members 106 impart a sufficiently large force on weighted ball 104 to cause it to reverse directions. As before, this process repeats itself as the user repeatedly reverses the direction of motion of inertial exercise device 100.

The various components of inertial exercise device 100 may be made from any materials. In one embodiment, all components are made from the same polymer such as polyvinyl chloride. Suspension members 106 are elastic and may be integrally formed with weighted inner ball 104, which itself may be elastic. In some embodiments, hollow outer ball 102 may be rigid while in other embodiments it may be elastic and inflatable. Hollow outer ball 102 may be a transparent elastic or rigid material such as a plastic or rubber, for example, silicone, polyurethane, polyvinylchloride or the like. If a rigid transparent material, hollow outer ball 102 may be coated with a transparent cushion or gel.

What has been described above is one embodiment of the general concept of an inertial exercise device in which a weighted core (such as weighted inner ball 104) is elastically suspended inside a hollow outer chamber (such as hollow outer ball 102) by suspension members (such as suspension members 106). The embodiment described above can be manufactured in many different ways, although particularly advantageous methods of construction are described below.

Figure 5:
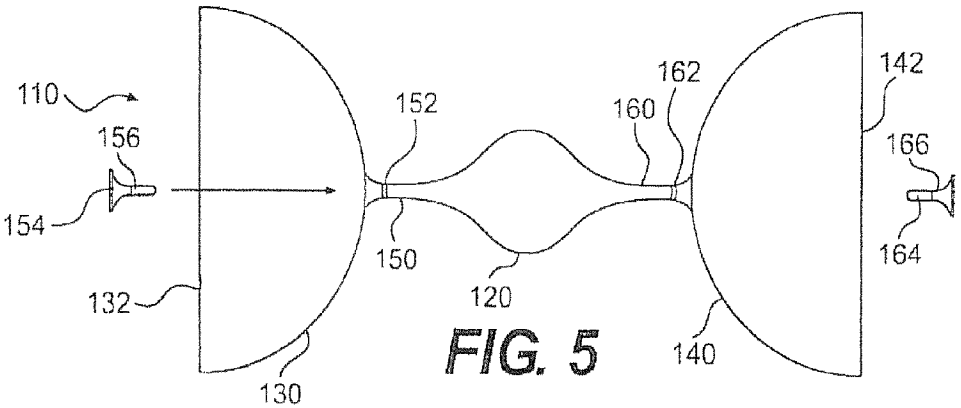
FIG. 5 is a front elevation view showing one embodiment of a tube for forming an inertial exercise device.

According to one type of construction, an inertial exercise device may be manufactured from a tube. As shown in FIG. 5, tube 110 for manufacturing an inertial exercise device comprises middle segment 120, outwardly expanding end segments 130 and 140, and neck segments 150 and 160. Neck segment 150 is disposed between end segment 130 and middle segment 120. Neck segment 160 is disposed between end segment 140 and middle segment 120. Middle segment 120 is a region of tube 110 with a larger diameter than the surrounding neck segments 150 and 160. In other words, middle segment 120 is a bulge in the center portion of tube 110. End segment 130 terminates in opening 132 and end segment 140 terminates in opening 142. In the illustrated embodiment, end segments 130 and 140 are generally hemispherical in shape and openings 132 and 142 are generally round. However, the illustrated embodiment is just one example of the possible shape of end segments 130 and 140 and openings 132 and 142 and other shapes are contemplated. For example, end segments 130 and 140 may be prolate hemispheroids, cones, rectangular semi-cuboids, or other three dimensional shapes.

Figure 6:
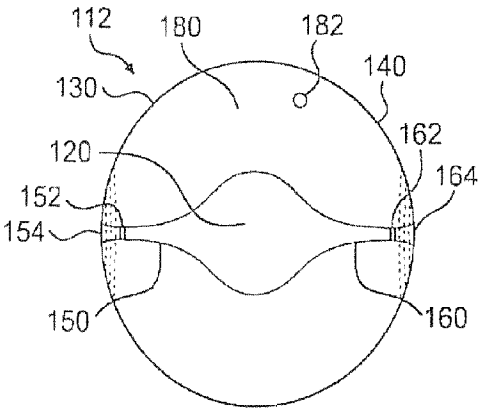
FIG. 6 is a front elevation view showing an inertial exercise device formed from the tube of FIG. 5.

To form inertial exercise device 112 from tube 110, end segments 130 and 140 are each everted (i.e., turned inside out) over middle segment 120, as shown in FIG. 6. Once end segments 130 and 140 are so everted, their ends are joined together at their respective terminal openings 132 and 142 so as to form an outer chamber such as outer ball 180 encapsulating middle segment 120. Thus, the hemispherical outer surfaces of end segments 130 and 140 in FIG. 5 become the inner surfaces of outer ball 180 of inertial exercise device 112 shown in FIG. 6. Although referred to as a "ball," it is to be understood that outer ball 180 may be any three dimensional shape, depending on the shapes of end segments 130 and 140, as explained above. Inertial exercise device 112 is thus essentially a hollow outer chamber (outer ball 180) with a tube passing completely through its center, the tube including a bulge (middle segment 120) that constitutes an inner chamber or core suspended inside the hollow outer chamber by suspension members (neck segments 150 and 160). At least neck segments 150 and 160 are made from an elastic material so that the inner chamber is elastically suspended inside the hollow outer chamber. In some embodiments, all of tube 110 is made from a pliant and elastic material so that the resulting hollow outer ball 180 and middle segment 120 are also pliant and elastic.

Middle segment 120 may be made from a very dense material, or may have extremely thick walls such that middle segment 120 is relatively heavy and has sufficient inertia to provide inertial exercise device 112 with the dynamic inertial properties described above with reference to inertial exercise device 100. However, middle segment 120 may also be made from the same material as all of tube 110 in which case weight must be added in order to increase the inertia of middle segment 120. For example, all of tube 110, or any sub-segment thereof, may be made from a polymer such as polyvinyl chloride.

In one embodiment, a fluid such as water is added to middle segment 120 to increase its inertia. To fill middle segment 120, first plug 154 is first inserted into first neck 150 in order to provide a seal to prevent leakage. Next, inertial exercise device 112 is rotated so that the axis defined by necks 150 and 160 is generally vertical and first plug 154 is on the bottom of inertial exercise device 112. Water (or other fluid) is then poured or injected into middle segment 120 through second neck 160 until it is full or reaches a desired weight. As water fills middle segment 120, it displaces air inside middle segment 120 which is forced up and out of second neck 160. Finally, second plug 164 is inserted into second neck 160 so as to seal middle segment 120 at both ends, thereby sequestering the water inside middle segment 120 and first and second necks 150 and 160.

Alternatively one or both of first and second plugs 154 and 164 may be permanently inserted into necks 150 and 160 respectively. To achieve this, first and second necks 150 and 160 may incorporate first and second locking rings 152 and 162 respectively, which have a slightly smaller diameter than the rest of necks 150 and 160. First and second plugs 154 and 164 may include grooves 156 and 166 respectively, which mate with first and second locking rings 152 and 162 respectively when plugs 154 and 164 are inserted into necks 150 and 160 respectively. First and second plugs may be made from any material including without limitation polymers such as polyvinyl chloride and polypropylene. First and second locking rings 152 and 162 may similarly be made from any material including without limitation metals and polymers.

Figure 7:
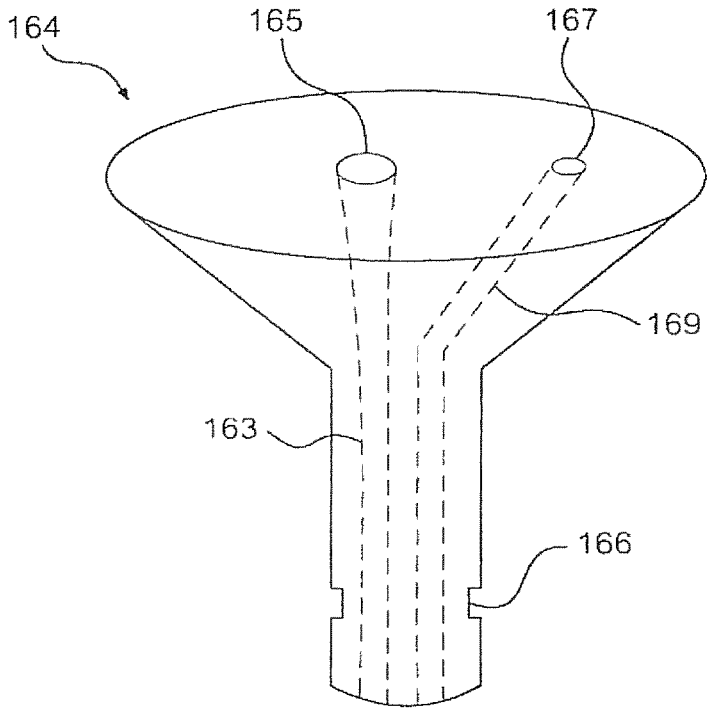
FIG. 7 is a perspective view of one embodiment of a plug optionally used in an inertial exercise device.

Particularly in embodiments where plugs 154 and 164 are permanently inserted into necks 150 and 160, second plug 164 may include water valve 165 and air bleed valve 167, as shown in FIG. 7. Both water valve 165 and air bleed valve 167 are in fluid communication with middle segment 120 via fill duct 163 and air bleed duct 169 respectively. To fill middle segment 120 with water, water is poured or injected through water valve 165 into fill duct 163 where it then passes into middle segment 120. As water fills middle segment 120, the air previously inside middle segment 120 is displaced by the water and is forced into air bleed duct 169 where it passes to the atmosphere through air bleed valve 167. After middle segment 120 is filled to the desired weight, water valve 165 and air bleed valve 167 are closed, for example with a cap, to prevent water from leaking from middle segment 120 while inertial exercise device 112 is in use.

Either before or after middle segment 120 is filled with water, outer ball 180 is inflated with a gas such as air. This may be accomplished by providing air fill valve 182 on outer ball 180, as shown in FIG. 6. Air fill valve 182 may be a conventional air fill valve as commonly found in inflatable exercise balls, beach balls, and the like. The user inflates outer ball 180, either by blowing into air fill valve 182 by mouth, or by using a pump, until outer ball 180 is fully inflated and taut so as to provide a relatively rigid structure for elastic suspension of middle segment 120.

The dynamic inertial characteristics of inertial exercise device 112 may be manipulated by varying the tube wall thickness along the length of tube 110, particularly the tube wall thickness in neck segments 150 and 160. For example, by increasing the tube wall thickness in neck segments 150 and 160, the spring constants of neck segments 150 and 160 will be increased so that a user must exert more force in order to cause middle segment 120 to oscillate through its full range of motion inside outer ball 180. On the other hand, decreasing the tube wall thickness in neck segments 150 and 160 decreases their spring constants and therefore makes it easier for a user to cause middle segment 120 to oscillate through its full range of motion inside outer ball 180.

The dynamic inertial characteristics of inertial exercise device 112 may also be manipulated by varying the amount of water or other fluid inside middle segment 120 and neck segments 150 and 160. By inflating middle segment 120 and neck segments 150 and 160 with water under pressure, the segments expand thereby increasing the amount of tension neck segments 150 and 160. Due to this increased tension, the spring constants of neck segments 150 and 160 are increased so that a user must exert more force in order to cause middle segment 120 to oscillate through its full range of motion inside outer ball 180. Filling middle segment 120 and neck segments 150 and 160 with relatively little water, the opposite effect is achieved.

Although middle segment 120, end segments 130 and 140, and neck segments 150 and 160 may all be segments of a single pliant tube 110, in some embodiments these segments may be molded separately and then joined together. For example, end segments 130 and 140, which may be identical in some embodiments, may each be molded separately using the same mold. Middle segment 120 and neck segments 150 and 160 may all be molded integrally together as one piece, or molded separately and then joined together after molding. The joining together of separate molded segments may be accomplished by heat welding, sonic welding, adhesives, or mechanical connections such as fasteners, clamps, crimps, locking rings or threaded engagement. Where middle segment 120, end segments 130 and 140, and neck segments 150 and 160 are molded separately, the various segments may be constructed from different materials from one another.

Figure 8:
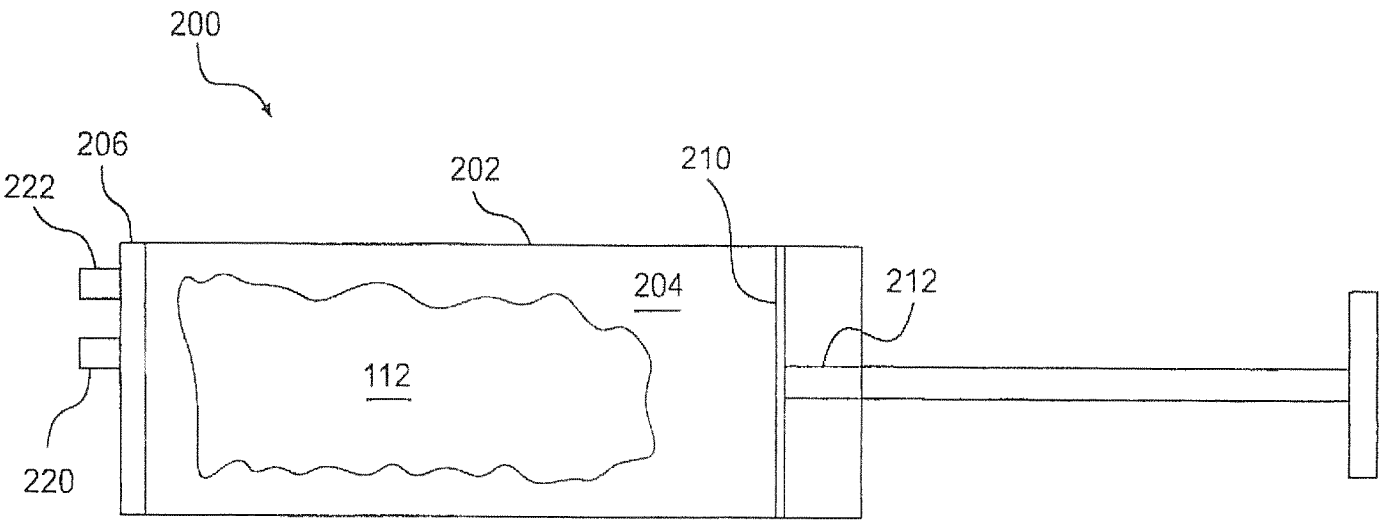
FIG. 8 is a front cross-sectional view of one embodiment of an inertial exercise device and pump kit.

In some embodiments, either or both of middle segment 120 and outer ball 180 may be filled with water and air respectively using a pump. For example, as shown in FIG. 8, air and water pump 200 may be provided and equipped with one or more nozzles that mate with water valve 165 and air fill valve 182. In this embodiment pump 200 has hollow cylindrical body 202 surrounding internal pump chamber 204. Piston 210 is slidably mounted within internal pump chamber 204, and is user operable with handle 214 which is connected piston 210 by rod 212. Pump 200 also includes end cap 206 which is removably engaged with one end of cylindrical body 202, for example by threaded engagement. End cap 206 forms an air and water tight seal with cylindrical body 202, and piston 210 forms an air and water tight seal with the walls of internal pump chamber 204. Accordingly, internal pump chamber 204 is an air and water tight chamber.

Cylindrical body 202 also includes intake port 220 and outlet port 222. Intake port 220 and outlet port 222 each include one-way check valves so that air or water can only travel through them in one direction. For intake port 220 the check valve only allows flow into internal pump chamber 204. For outlet port 222 the check valve only allows flow out of internal pump chamber 204. Thus, as a user forces piston 210 toward end cap 206, the fluid (e.g., air or water) inside internal pump chamber 204 is forced out through outlet port 222 and none of the fluid escapes through intake port 220. Conversely, when a user pulls piston 210 away from end cap 206, fluid is drawn into internal pump chamber 204 through intake port 220.

Figure 9:
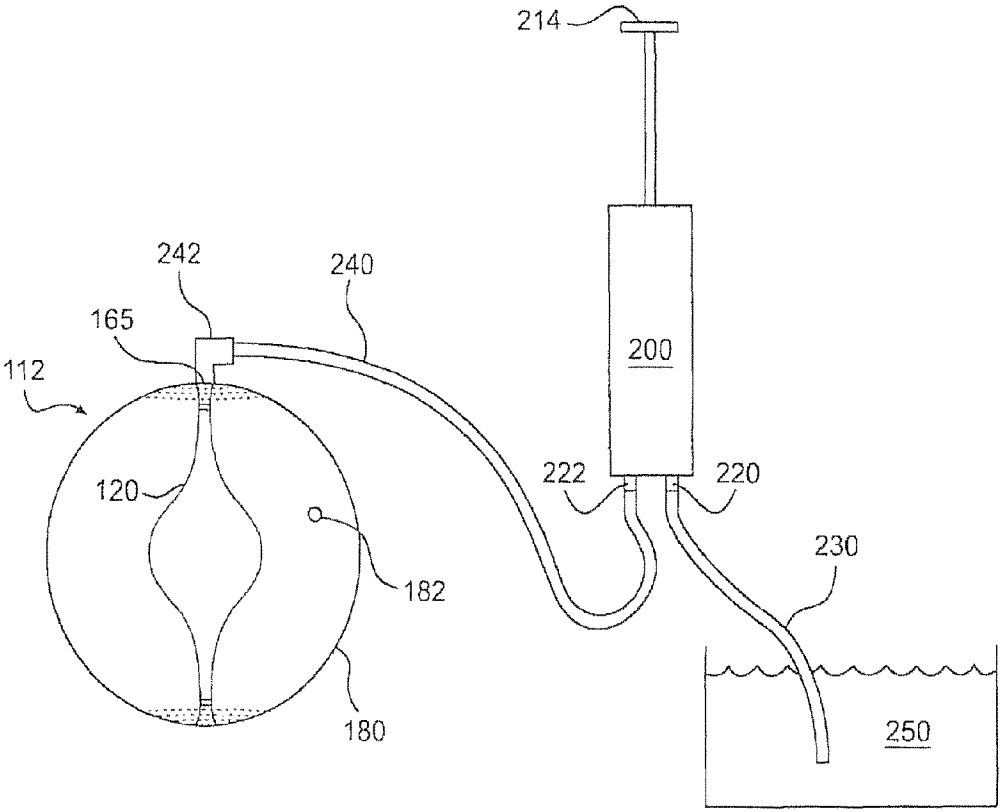
FIG. 9 is a perspective view of the kit of FIG. 8 in use.

As shown in FIG. 9, pump 200 may further include inlet hose 230 and/or outlet hose 240. Inlet hose 230 is particularly useful when pump 200 is used to pump water from water supply 250 into middle segment 120 of inertial exercise device 112. In this case, inlet hose 230 is connected to intake port 220 and has its opposite end inserted into water supply 250. Outlet hose 240 is connected to outlet port 222 at one end and includes connector 242 at the other end. Connector fitting 242 is adapted for engagement with water valve 165 and/or air fill valve 182. As shown in FIG. 9, when handle 214 is drawn upward, water from water supply 250 is drawn through inlet hose 230 into pump 200, and then expelled through outlet port 222 into outlet hose 240 and into middle segment 120 of inertial exercise device 112 via connector fitting 242 engaged with water valve 165 when handle 214 is depressed downward. Although not shown, pump 200 can be used to pump air into outer sphere 180 of inertial exercise device 112 by simply connecting connector fitting 242 to air fill valve 182 and exposing intake port 220 to ambient air before operating pump 200.

One unique feature of pump 200 is that it can be combined with inertial exercise device 112 to form an inertial exercise device kit as shown in FIG. 8. More particularly, end cap 206 can be removed from hollow cylindrical body 202 so that inertial exercise device 112 (after being deflated of air and emptied of water) can be inserted into internal pump chamber 204 and enclosed therein by replacing end cap 206. This is particularly convenient for shipping inertial exercise device 112 and pump 200 to consumers as the shipping container only needs to be large enough to accommodate pump 200, since inertial exercise device 112 is inside pump 200. To further decrease the size of pump 200, handle 214 and rod 212 may be removable from piston 210, for example by threaded engagement between rod 212 and piston 210.

Figure 10:
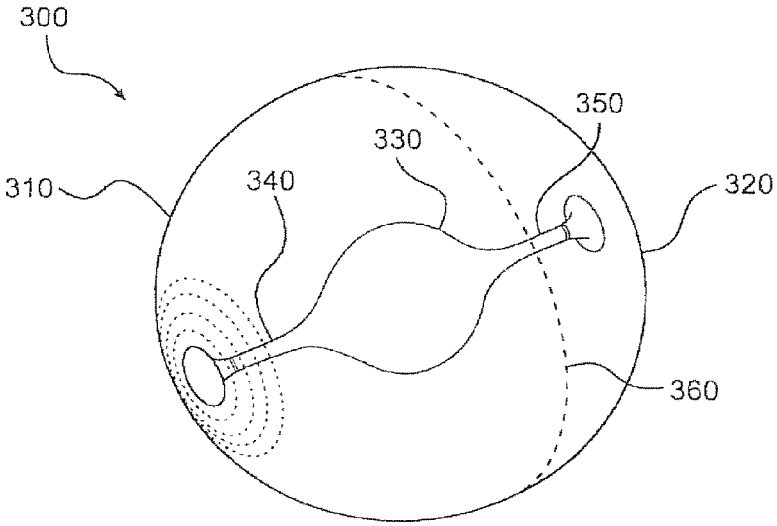
FIG. 10 is a perspective view of another embodiment of an inertial exercise device.
Figure 11:
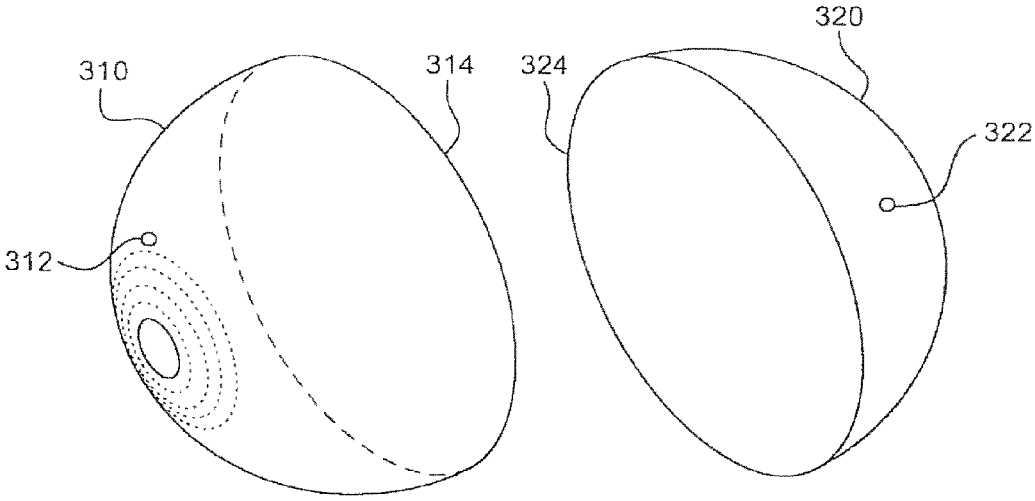
FIG. 11 is a perspective view of one embodiment of disassembled outer shell components of the inertial exercise device of FIG. 10.

As seen in FIGS. 10 and 11, alternative embodiments of an inertial exercise device are not made from an everted tube. For example, inertial exercise device 300 includes a rigid outer shell formed from first and second rigid outer shell components 310 and 320. Here, first rigid outer shell component 310 and second rigid outer shell component 320 are both hemispheres but in other embodiments may be any three dimensional shape, similar to first and second end segments 130 and 140 discussed above. First rigid outer shell component 310 has first engagement edge 314 which engages with second engagement edge 324 of second rigid outer shell component 320. First and second engagement edges 314 and 324 may engage with each other in any way, including threaded engagement, snap or press fit engagement, adhesives, or welding. First and second rigid outer shell components 310 and 320 also include openings 312 and 322 respectively, for a purpose to be described below.

Figure 12:
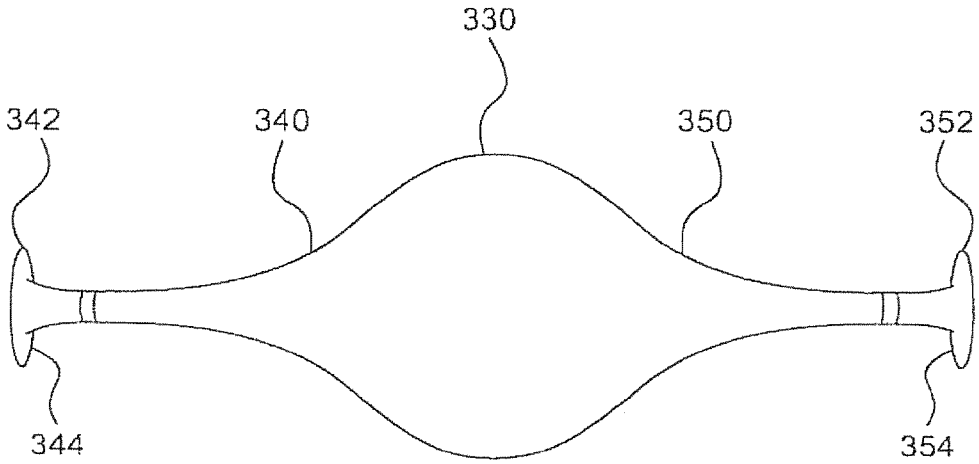
FIG. 12 is a front elevation view of one embodiment of an internal weight for suspension inside the inertial exercise device of FIG. 10.

FIGS. 10 and 12 show weight 330 which is elastically suspended inside rigid outer shell 320 by elastic suspension members 340 and 350. In this embodiment, weight 330 may or may not be a water-filled chamber and instead may simply be a heavy item such as a metallic slug or a heavy rubber mass. Suspension members 340 and 350 may be integrally formed with weight 330. End anchors 342 and 352 are used to anchor the ends of suspension members 340 and 350 on openings 312 and 322 of first and second outer shell components 310 and 320 respectively. Flanges 344 and 354 of end anchors 342 and 352 respectively are larger in diameter than openings 312 and 322. In one embodiment, anchors 342 and 352 are integrally formed with suspension members 340 and 350 respectively, and anchors 342 and 352 are made from a flexible material such that flanges 344 and 354 may be folded inward so that anchors 342 and 352 can be inserted through openings 312 and 322 from the inside out, and then unfolded so that flanges 344 and 354 are braced against the outer surfaces of outer shell 360 surrounding openings 312 and 322. In one embodiment, anchors 342 and 352, suspension members 340 and 350 and weight 330 are all integral parts of a single flexible tube. In this embodiment, weight 330 may be a bulge in the middle segment of the tube, and this bulge may be fillable with water through a fill valve in either end anchor 342 and 352, or optionally through a fill valve incorporated into the bulge itself.

Figure 13:
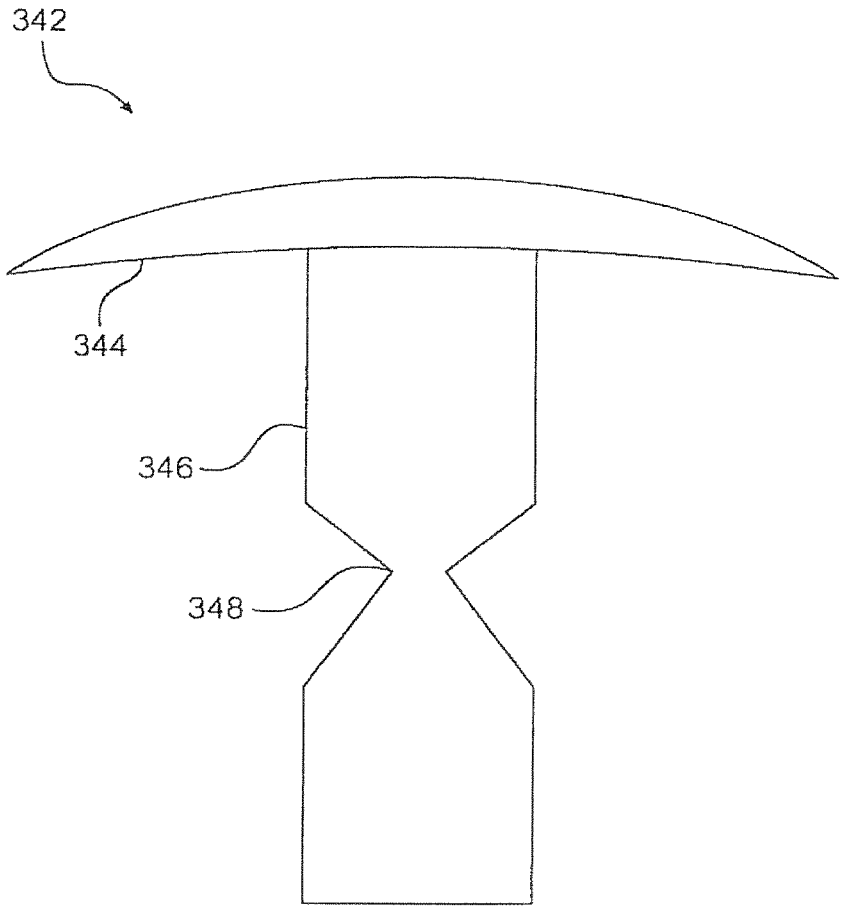
FIG. 13 is a front elevation view of one embodiment of an anchor for mounting an elastically suspended internal weight in the inertial exercise device of FIG. 10.

Alternatively, anchors 342 and 352 may be made from a relatively rigid material, in which case anchors 342 and 352 are removable from suspension members 340 and 350 respectively, as shown in FIG. 13. If so, weight 330 is suspended inside outer shell 360 by removing anchors 342 and 352 from their respective suspension members, and then inserting anchors 342 and 352 through openings 312 and 322 respectively, from the outside of outer shell 360 and then reattaching anchors 342 and 352 to their respective suspension members. The means of attachment between anchors 342 and 352 and suspension members 340 and 350 may be a groove 348 in shaft 346 of anchor 342 and a locking ring (not shown) of smaller diameter that shaft 346. In this case suspension member 340 is a hollow tube and is slid over shaft 346 past groove 348, and then the locking ring is placed over suspension member 340 in groove 348. A similar means of attachment is provide for anchor 352 and suspension member 350. In this embodiment, weight 330 may be integrally formed with suspension members 340 and 350 as part of a single tube, and weight 330 may be formed as a bulge in the tube, and may be filled with water, particulate matter such as sand, or any other heavy material.

Figure 14:
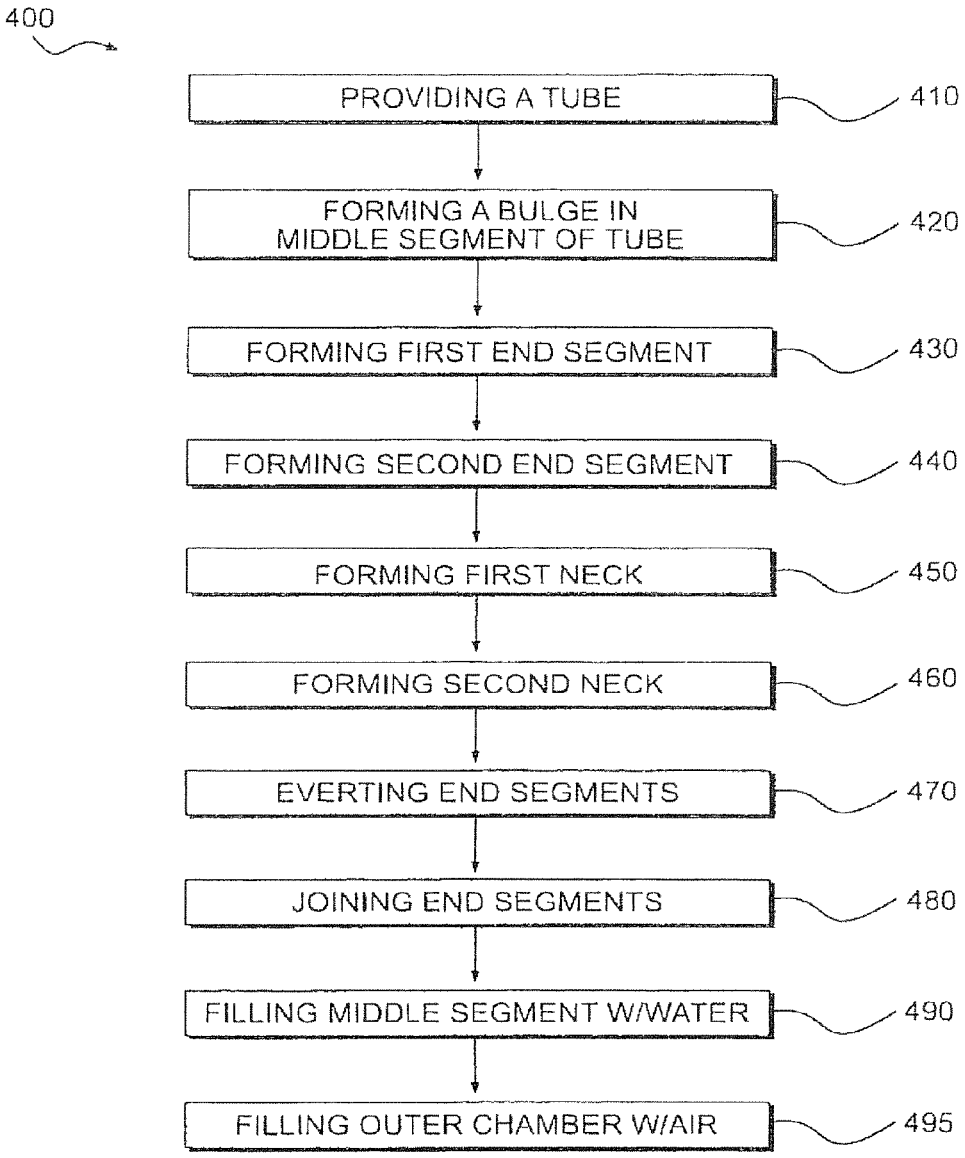
FIG. 14 is flow chart for a method of manufacturing an inertial exercise device.

FIG. 14 shows a method 400 for manufacturing an inertial exercise device. The process begins by providing a tube (410). The tube is typically plastic and may be formed by, for example melting raw plastic and molding it into a tube shape. A bulge is then formed in a middle segment of the tube (420). The bulge may be formed by conventional molding techniques such as, for example, blow molding or rotational molding. The bulge is typically approximately spherical or prolate spheroidal, but may be other three dimensional shapes.

A first end segment is formed in the tube (430) and a second end segment is formed in the tube (440). The first and second end segments are approximately identical mirror images of one another, and increase in diameter (i.e., outwardly expand) as the distance from the middle segment increases. The first and second end segments may be hemispherical or any other three dimensional shape. The first and second end segments terminate in openings, but these openings may or may not be present when the first and second end segments are formed. For example, the openings may be formed by cutting closed ends from the first and second end segments. The first and second end segments have maximum diameters greater than the maximum diameter of the middle segment.

A first neck segment is formed in the tube (450) and a second neck segment is formed in the tube (460). The first neck segment is disposed between the first end segment and the middle segment. The second neck segment is disposed between the second neck segment and the middle segment. The neck segments have a maximum diameter less than the maximum diameter of the middle segment. At least the neck segments, if not the rest of the tube as well, are formed from a material that is elastic after molding is complete. The wall thickness of the neck segments may vary along their length so as to vary the dynamic inertial characteristics of the completed device, as the neck segments later serve as suspension members.

The first and second end segments are everted (470) over the middle segment and the neck segments. In other words, the outwardly expanding end segments are pliable and turned inside out and pulled towards each other until their ends meet approximately aligned with the middle of the tube. This eversion of the end segments may be performed manually or mechanically. As the end segments are approximately identical mirror images, their open ends are approximately the same size and shape so that their terminal edges align with one another. The two end segments are then joined together (480) to form a hollow outer chamber encapsulating the middle segment. This joint may be formed by thermal or sonic welding, adhesives, or any other method of creating a permanent, air-tight joint. The middle segment is filled with water, sand, or other heavy material (490). The hollow outer chamber is inflated with a gas such as air (495). To accomplish this filling of the middle segment and the hollow outer chamber, various plugs and air and/or water valves may be provided, for example the types of plugs and valves disclosed above.

Figure 15:
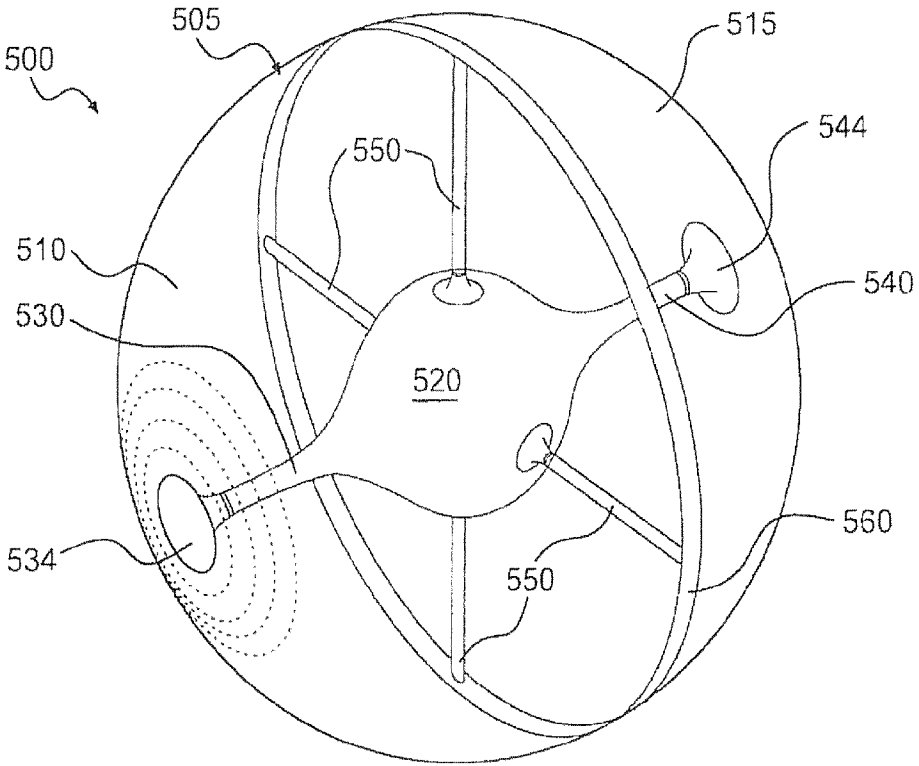
FIG. 15 is a perspective view of another embodiment of an inertial exercise device.

It is to be understood that all of the embodiments disclosed above optionally include more than two suspension members. For example, inertial exercise device 500 shown in FIG. 15 has a total of six suspension members, including first suspension member 530, second suspension member 540, and radial suspension members 550. First and second suspension members 530 and 540 may be made according to any of the constructions disclosed above, for example by molding integrally with weighted inner chamber 520 as a single tube. Similarly, hollow outer chamber 505 may be molded integrally with first and second suspension members 530 and 540 and weighted inner chamber 520, hollow outer chamber 505 being formed by everting first and second end segments 510 and 515 of the single integral tube. Alternatively, hollow outer chamber 505 and first and second suspension members 530 and 540 may be formed separately and then joined together at end caps or valves 534 and 544.

In this embodiment, radial suspension members 550 provide additional elastic suspension forces. Here, four radial suspension members 550 are provided, but in other embodiments there may be more or less than four. Each radial suspension member 550 is attached to weighted inner chamber 520 at one end and attached to ring joint 560 at the opposite end. Ring joint 560 may be either rigid or flexible and serves to join the two halves of hollow outer chamber 505 (which may be first and second end segments 510 and 515 of an integral tube). For example, ring joint 560 may be made from a rigid plastic such as polyvinyl chloride or acrylonitrile butadiene styrene (ABS). The inner surface of ring joint 560 may include attachment points such protrusions or nipples that engage with open ends of radial suspension members 550. The open ends of radial suspension members 550 may be secured to the attachment points ring joint 560 by clamps, rings, elastic bands, thermal or sonic welding, adhesives, and/or any other suitable method.

Many modifications to the above embodiments are also contemplated. For example, any of the above embodiments may incorporate radial suspension members such as radial suspension members 550. Further any or all of the suspension members in the embodiments disclosed above may be variable in tension. For example, in addition to varying the wall thickness in a tubular suspension member, as disclosed above, the suspension members may be twisted in order to increase their spring constants. Any of the embodiments disclosed above may also incorporate handles or other gripping members to facilitate holding the device.

The embodiments disclosed above can be used to perform a wide variety of exercises. The basic exercise involves quickly moving the inertial exercise device in alternating directions so as to constantly work against the inertia of the elastically suspended inner core. This movement of the inertial exercise device is not necessarily linear. For example, the user may quickly move the inertial exercise device in random directions in any of the three dimensions. Further, the movements may be arcuate, such as when a user holds the inertial exercise device at chest level and quickly twists his torso in opposite directions.

The inertial exercise device can also be used to increase the difficulty of basic exercises. For example, a user may perform rapid stomach crunches while holding the inertial exercise device to her chest. Other exercises, such as lunges and squats, are also more challenging if performed while holding the inertial exercise device. Additionally, the inertial exercise device can be used as a platform for performing pushups, sit-ups, and other exercises. Where the inertial exercise device is round, its tendency to roll forces the user to use core muscles to stabilize the inertial exercise device, thereby increasing the difficulty of exercises performed with the inertial exercise device serving as a platform.

It can thus be seen that the embodiments disclosed above incorporate and improve upon the best features of both medicine balls and inflatable exercise balls. The inertial exercise device is not simply a weight, and is not simply an apparatus for performing exercises. Further, the design of the inertial exercise device allows a user to perform dynamic inertial exercises not possible with either medicine balls or inflatable exercise balls. In some embodiments, the inertial exercise device may be emptied of both air and water so that it is light and compact when not in use, unlike medicine balls, which are heavy and bulky to store when not in use.

Another significant advantage of the inertial exercise devices disclosed above is that, in some embodiments, it may be manufactured using common molding techniques. In the past it has not been feasible to affordably mold concentric polymeric spheres or chambers because if the inner sphere is molded first, it is destroyed by the heat required to mold the outer sphere. However, by forming an inertial exercise device by everting a tube, it is possible mold the entire device simultaneously, thereby eliminating problems associated with sequential molding of the inner and outer spheres or chambers.

In all of the devices and methods disclosed above, the dimensions of each of the components are not critical. For example, the inertial exercise device may be as large as several feet in diameter or as small as a few inches. It is advantageous if the hollow outer chamber or ball has a diameter at least twice as great as the diameter of the weighted inner ball or middle tube segment so that a greater range of oscillation is provided, but this is not a requirement. Similarly, the various components may be made from any material, though pliable and elastic materials are advantageous, particularly for the suspension members (neck segments) as they provide necessary elasticity to the dynamic inertial system.

Additionally, although the devices disclosed above are referred to as "exercise" devices, this is not intended to be limiting. For example, the devices disclosed above can be used for other purposes besides exercise, for example as children's toys, physical rehabilitation devices, hand-eye coordination training devices, and any other purpose. For example, in one embodiment the hollow outer chamber or ball may be six inches or small in diameter, so that the device is a relatively small ball or other object that is easily thrown. Due to the elastically suspended weighted inner core, the flight of such an object will be erratic and difficult to predict, and as such the device may be suitable as a toy or hand-eye coordination training device. In summary, the appended claims are intended to cover the structures disclosed herein, and not only when those structures are used for the purpose of exercise.

The examples set forth above are provided to give those of ordinary skill in the art a complete disclosure and description of how to make and use the preferred embodiments of the devices, and are not intended to limit the scope of what the inventor regards as the invention. Modifications of the above-described modes for carrying out the invention that are obvious to persons of skill in the art are intended to be within the scope of the following claims. All publications, patents, and patent applications cited in this specification are incorporated herein by reference as if each such publication, patent, or patent application were specifically and individually indicated to be incorporated herein by reference. Finally, it is to be understood that in any method claims, the recited steps may be performed in any order, including simultaneously.

What is claimed is:

1. An inertial exercise apparatus, comprising:

an inner ball elastically and concentrically suspended inside a hollow outer ball by a plurality of opposing suspension members, wherein the inner ball is fillable with a fluid consisting of a liquid, gel, oil, or particulate from outside the hollow outer ball, and wherein at least one of the opposing suspension members comprises a neck segment through which the fluid can be delivered to the inner ball.

2. The apparatus according to claim 1, wherein when the inner ball is filled with a fluid consisting of a liquid, gel, oil, or particulate under pressure, the inner ball expands and increases tension in the plurality of opposing suspension members so as to increase resistance of motion of the inner ball relative to the hollow outer ball.

3. The apparatus according to claim 1, wherein the hollow outer ball and the inner ball are each integrally formed together from a pliant tube, comprising:

a middle segment with a maximum diameter equal to a first diameter; and first and second end segments, each end segment dispose on opposite sides of the middle segment and terminating in an opening with a second diameter greater than the first diameter wherein the hollow outer ball is integrally formed by everting the first and second end segments of the pliant tube over the middle segment and joining the first and second end segments together at their respective openings, and wherein the inner ball is integrally formed from the middle segment.

4. The apparatus according to claim 3, wherein the pliant tube further comprises:

a first neck disposed between the first end segment of the pliant tube and the middle segment of the pliant tube, the first neck having a first minimum inner diameter less than the first diameter; and a second neck disposed between the second end segment and the middle segment, the second neck having a second minimum inner diameter less than the first diameter.

5. The apparatus according to claim 4, wherein the first minimum inner diameter is equal to the second minimum inner diameter.

6. The apparatus according to claim 5, further comprising a first watertight plug disposed in the first neck and a second watertight plug disposed in the second neck.

7. The apparatus according to claim 6, wherein the first watertight plug comprises a valve with a first position allowing fluid communication into the inner ball from outside the inner ball and a second position prohibiting fluid communication into the inner ball from outside the inner ball.

8. The apparatus according to claim 4, wherein the pliant tube has a variable wall thickness.

9. The apparatus according to claim 8, wherein the plurality of opposing suspension members has a variable elasticity dependent upon the wall thickness of the pliant tube adjacent to the first and second necks.

10. The apparatus according to claim 1, the hollow outer ball further comprising a first rigid outer shell with a first engagement edge and a second rigid outer shell with a second engagement edge, wherein the hollow outer ball is formed by engaging the first rigid outer shell to the second rigid outer shell at the first and second engagement edges, and wherein each engagement edge is configured to engage with the other engagement edge.

11. The apparatus according to claim 10, wherein the first and second engagement edge are each configured to engage through a threaded fastener engagement.

12. The apparatus according to claim 10, wherein the first and second engagement edge are each configured to engage through a snap fit engagement.

13. The apparatus according to claim 10, wherein the first and second engagement edge are each configured to engage through a press fit engagement.

14. The apparatus according to claim 10, wherein the plurality of opposing suspension members is integrally formed with an additional weight, and wherein the plurality of opposing suspension members is rigidly connected to a plurality of end anchors, each end anchor configured to anchor a respective opposing suspension member to the hollow outer ball.

15. The apparatus according to claim 14, wherein the plurality of end anchors is integrally formed with the plurality of opposing suspension members.

16. The apparatus according to claim 14, wherein the additional weight, the plurality of opposing suspension members, and the plurality of end anchors are integral parts of a single tube.

17. The apparatus according to claim 16, further comprising a bulge disposed in the single tube and a fill valve disposed on the plurality of end anchors, wherein the additional weight is formed by filling the bulge with a fluid through the fill valve.

18. The apparatus according to claim 10, wherein the inner ball is elastically and concentrically suspended inside the hollow outer ball by a plurality of radial suspension members configured to provide elastic suspension forces to the inner ball.

19. An exercise kit, comprising:

an inertial exercise apparatus comprising:

an inflatable outer chamber having an inner wall;

a fluid fillable inner chamber elastically and concentrically attached to the inner wall of the inflatable outer chamber by a plurality of opposing suspension members, at least one of the two opposing suspension members having a neck segment through which a fluid can be delivered to the fluid fillable inner chamber from outside the inflatable outer chamber;

a fill valve in fluid communication with the fluid fillable inner chamber and accessible from outside the inflatable outer chamber; and a pump comprising a pump chamber in fluid communication with a pump hose, the pump hose terminating in a fitting engageable with the fill valve;

wherein the pump chamber is configured to enclose the apparatus when the inflatable outer chamber is deflated and the fluid fillable inner chamber is empty of fluid.

20. The apparatus according to claim 19, further comprising an air fill valve in fluid communication with the inflatable outer chamber, and wherein the fitting of the pump hose is engageable with the air fill valve.

21. An inertial exercise apparatus, comprising:

an inner chamber elastically suspended inside a hollow outer chamber by a plurality of opposing suspension members, wherein the inner chamber is fillable with a fluid consisting of liquid, gel, oil, or particulate from outside the hollow outer chamber, and wherein at least one of the opposing suspension members comprises a neck segment through which fluid can be delivered to the inner chamber.

* * * * *